US008923737B2

(12) United States Patent
Sato

(10) Patent No.: US 8,923,737 B2
(45) Date of Patent: Dec. 30, 2014

(54) FIXING DEVICE, AND IMAGE FORMING APPARATUS

(71) Applicant: Fuji Xerox Co., Ltd., Tokyo (JP)

(72) Inventor: Ryuichi Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 68 days.

(21) Appl. No.: 13/871,400

(22) Filed: Apr. 26, 2013

(65) Prior Publication Data

US 2014/0099137 A1 Apr. 10, 2014

(30) Foreign Application Priority Data

Oct. 5, 2012 (JP) ..... 2012-223171

(51) Int. Cl.
*G03G 15/20* (2006.01)

(52) U.S. Cl.
CPC ..... *G03G 15/2039* (2013.01); *G03G 15/2042* (2013.01); *G03G 15/2007* (2013.01)
USPC ..... 399/320; 399/27; 399/37; 399/88; 399/400; 355/67; 358/475

(58) Field of Classification Search
USPC ..... 399/27, 37, 88, 400, 320, 67, 122
See application file for complete search history.

(56) References Cited

U.S. PATENT DOCUMENTS 5,669,038 A * 9/1997 Kishimoto ..... 399/67

FOREIGN PATENT DOCUMENTS

| | | |
|---|---|---|
| JP | A-2004-133444 | 4/2004 |
| JP | A-2008-275945 | 11/2008 |
| JP | A-2009-276570 | 11/2009 |

* cited by examiner

*Primary Examiner* — Walter L Lindsay, Jr.
*Assistant Examiner* — Roy Y Yi
(74) *Attorney, Agent, or Firm* — Oliff PLC

(57) ABSTRACT

A fixing device includes a light irradiation portion that irradiates a recording medium transported to a predefined position with light, a power supply member that is disposed at a position which is irradiated with light with a first intensity of light emitted from the light irradiation portion in a state in which the recording medium is disposed at the predefined position and which is irradiated with light with a second intensity larger than the first intensity of light in a state in which the recording medium is not disposed at the predefined position, and that changes a physical property thereof so as to reduce the supply of power when the power supply member is continuously irradiated with the light with the second intensity for a predefined time or more, and a power supply portion that supplies power to the light irradiation portion via the power supply member.

5 Claims, 6 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2012-223171 filed Oct. 5, 2012.

BACKGROUND (i) Technical Field

The present invention relates to a fixing device, and an image forming apparatus.

(ii) Related Art

As an image fixing method in an electrophotographic image forming apparatus, there is a noncontact fixing technique in which toner on paper is overheated and melted by intermittently turning on a flash lamp. In addition, in recent years, due to lower price and increasing power density of a semiconductor laser, a fixing device is proposed in which a flash lamp is replaced with the high-power semiconductor laser.

SUMMARY

According to an aspect of the invention, there is provided a fixing device including a light irradiation portion that irradiates a recording medium transported to a predefined position with light, a power supply member that is disposed at a position which is irradiated with light with a first intensity of light emitted from the light irradiation portion in a state in which the recording medium is disposed at the predefined position and which is irradiated with light with a second intensity larger than the first intensity of light emitted from the light irradiation portion in a state in which the recording medium is not disposed at the predefined position, and that changes a physical property thereof so as to reduce the supply of power when the power supply member is continuously irradiated with the light with the second intensity for a predefined time or more, and a power supply portion that supplies power to the light irradiation portion via the power supply member.

BRIEF DESCRIPTION OF THE DRAWINGS

Exemplary embodiments of the present invention will be described in detail based on the following figures, wherein.

DETAILED DESCRIPTION

Configuration

Figure 1:
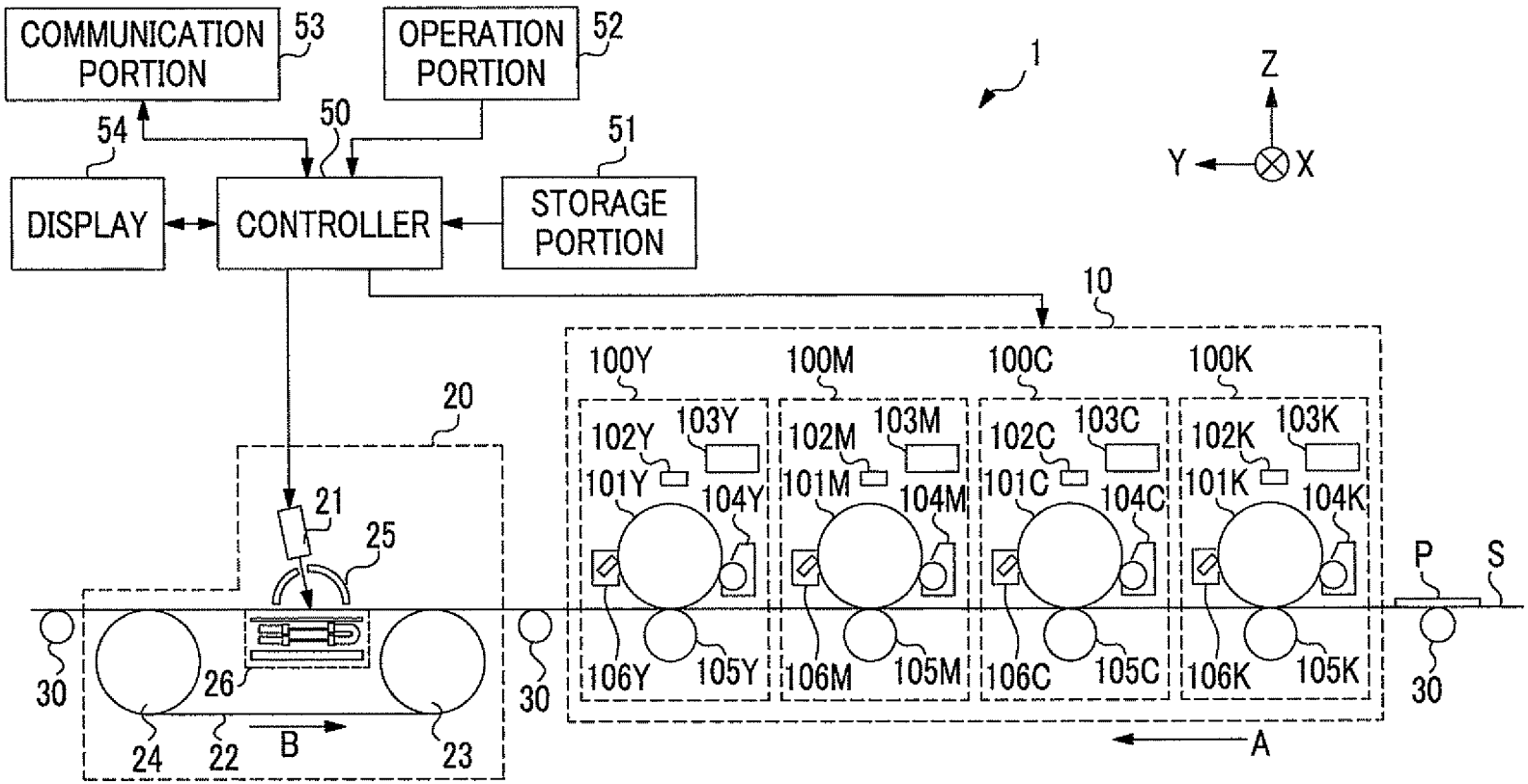
FIG. 1 is a diagram illustrating a configuration of an image forming apparatus according to an exemplary embodiment.

FIG. 1 is a schematic diagram illustrating a configuration of an image forming apparatus 1 according to an exemplary embodiment of the invention. The image forming apparatus 1 includes an image forming portion 10, a fixing device 20, and plural rollers 30. In addition, the image forming apparatus 1 includes a controller 50, a storage portion 51, an operation portion 52, a communication portion 53, and a display 54. The image forming apparatus 1 is an apparatus which forms an image on paper P which is an example of the recording medium in an electrophotographic method, and is an example of the image forming apparatus related to the invention. The image forming apparatus 1 forms an image on the paper P on the basis of image data received from an external apparatus or image data stored in advance. In addition, the paper P is paper with a predefined size such as series A or series B, but a size of the paper P is not limited to this size. The paper P may be continuous paper which is continued in a transport direction of the paper P. Further, materials of the paper P are not limited to specific materials.

The rollers 30 are rollers for transporting the paper P. The rollers 30 are rotated by motors (not shown) so as to feed the paper P along a transport path S of the paper in the arrow A direction and to transport the paper P to the image forming portion 10 or the fixing device 20. In addition, in relation to the transport path S, in the following description, the arrow A direction which is a direction in which the paper P is transported is referred to as downstream, and a direction opposite to the arrow A is referred to as upstream.

The image forming portion 10 forms toner images for respective colors of yellow (Y), magenta (M), cyan (C), and black (K) based on image data and transfers the formed toner images onto the paper P. For this, the image forming portion 10 includes image forming units 100Y, 100M, 100C and 100K for the respective colors of yellow (Y), magenta (M), cyan (C), and black (K). The image forming units are arranged in order of the image forming unit 100K, the image forming unit 100C, the image forming unit 100M, and the image forming unit 100Y from the upstream side in the transport direction. In addition, among the constituent elements shown in FIG. 1, the constituent element given the letter (Y, M, C or K) at the end of the reference numeral indicates that the constituent element corresponds to any one of the four colors. The respective units are common to a configuration or a function except that corresponding colors are different, and thus configurations of the image forming units will be described by exemplifying the image forming unit 100K.

The image forming unit 100K includes a photoconductor 101K, a charging device 102K, an exposure device 103K, a developing device 104K, a roller 105K, and a cleaning device 106K. The photoconductor 101K is a cylindrical component in which a photoconductive layer is formed on its surface. The photoconductor 101K (an example of the image holding member) is rotated by a motor (not shown) and thereby a toner image is formed on the surface thereof. The charging device 102K is a device which charges the surface of the photoconductor 101K through corona discharge. The exposure device 103K includes a light source which emits light, and irradiates the photoconductor 101K with light on the basis of image data so as to form an electrostatic latent image corresponding to the image data on the photoconductor 101K. The developing device 104K is a device which forms (develops) a toner image corresponding to the latent image formed on the photoconductor 101K and forms the toner image with a black toner. The cylindrical roller 105K is opposite to the photoconductor 101K with the transport path S interposed therebetween. The roller 105K transfers the toner image formed on the surface of the photoconductor 101K onto the paper P which is transported to a gap between the photoconductor 101K and the roller 105K. The cleaning device 106K is a device which removes toner which is not transferred to the paper P and remains on the surface of the photoconductor 101K.

The fixing device 20 is a device which fixes the toner image transferred to the paper P in the image forming portion 10 onto the paper P. The fixing device 20 is provided further toward the downstream side of the transport path S than the image forming portion 10, and includes a light generating portion 21 (an example of the laser light irradiation portion), a belt 22, a roller 23, a roller 24, a reflection mirror (light collecting member) 25, and a power supply portion 26. The light generating portion 21 irradiates the paper P which is transported to a predefined position with laser light by using supplied power, so as to fix the toner image formed on the paper P to the recording medium. The belt 22 is an endless belt which transports the paper P to which the toner image is transferred toward the downstream side of the transport path S. The belt 22 is hung over the roller 23 and the roller 24, and is moved by the roller 24 which is rotated by, for example, a motor (not shown) in the arrow B direction so as to transport the paper P. The reflection mirror 25 collects laser light which is emitted to the paper P by the light generating portion 21 and is reflected thereon. The power supply portion 26 supplies power to the light generating portion 21.

Figure 2:
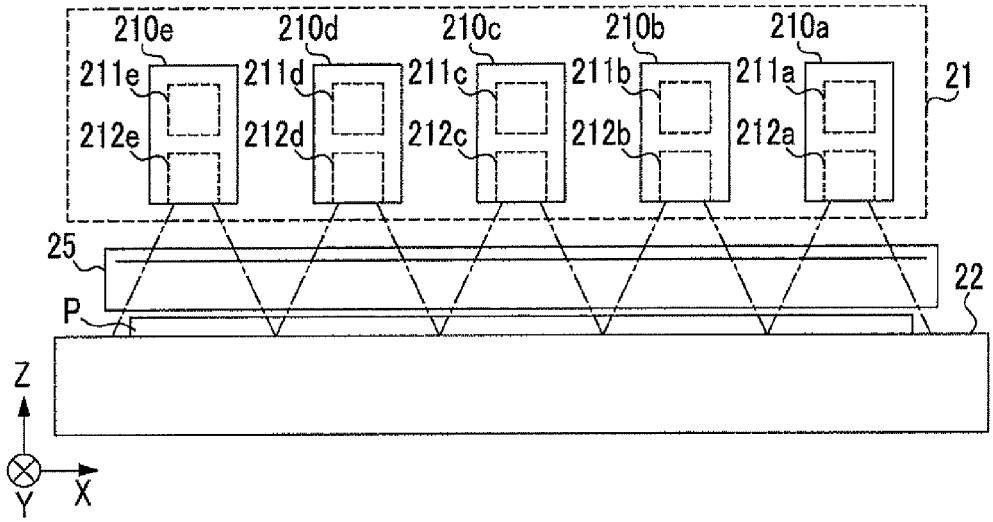
FIG. 2 is a schematic diagram of a fixing device viewed from an upstream side in a transport direction.

FIG. 2 is a schematic diagram of the fixing device 20 viewed from the upstream side in the transport direction. The light generating portion 21 generates laser light for heating toner transferred to the paper P, and is disposed at a position opposite to the paper P transported on the transport path S. The light generating portion 21 includes irradiation units 210*a* to 210*e*, and each unit includes a light source 211 generating laser light and an irradiation part 212 irradiating the paper P with laser light generated by the light source 211. In addition, in FIG. 2, the letter (a, b, c, d, or e) given at the end of the reference numeral of the light source and the irradiation part indicates that the constituent element corresponds to any one of the irradiation units 210*a* to 210*e*. Each light source includes plural laser elements generating laser light. The laser element uses, for example, a solid laser, a liquid laser, a gas laser, a semiconductor laser, or the like. Each irradiation part includes one or plural optical components. Laser light generated by the light source 211*a* is diffused by the optical component of the irradiation part 212*a*, and is emitted in the direction of the belt 22. Also in the other light sources 211*b* to 211*e*, generated laser light is diffused by the irradiation part given the same letter at the end of the reference numeral as the light source and is then emitted to the belt 22.

The irradiation units 210*a* to 210*e* are arranged in a line in a direction intersecting the transport direction along the surface of the belt 22. Specifically, as shown in FIG. 2, when the transport direction of the paper is set to an Y axis, direction intersecting the Y axis is set to an X axis along the surface of the belt 22, and a direction intersecting the X axis and Y axis is set to a Z axis, the irradiation units 210*a* to 210*e* are arranged in a line in the X axis direction (the width direction of the belt 22). The light generating portion 21 performs a laser output when the paper P is transported to a position (hereinafter, referred to as an "irradiation position") which is irradiated with laser light under the control of the controller 50.

Figure 3A:
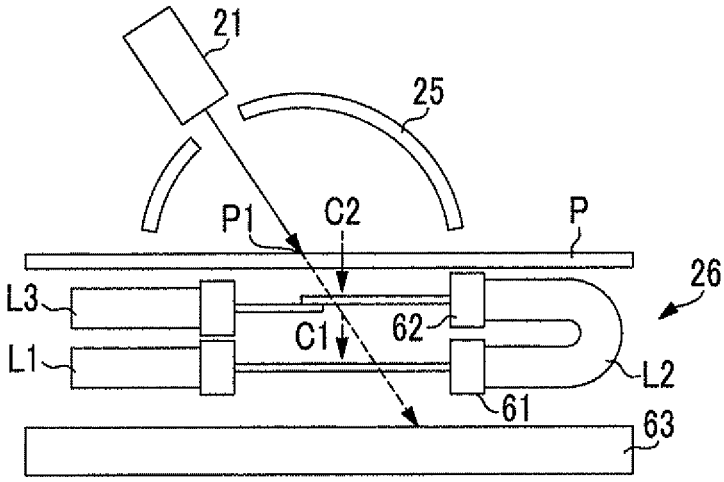
FIGS. 3A and 3B are diagrams illustrating a light generating portion and a power supply portion.
Figure 3B:
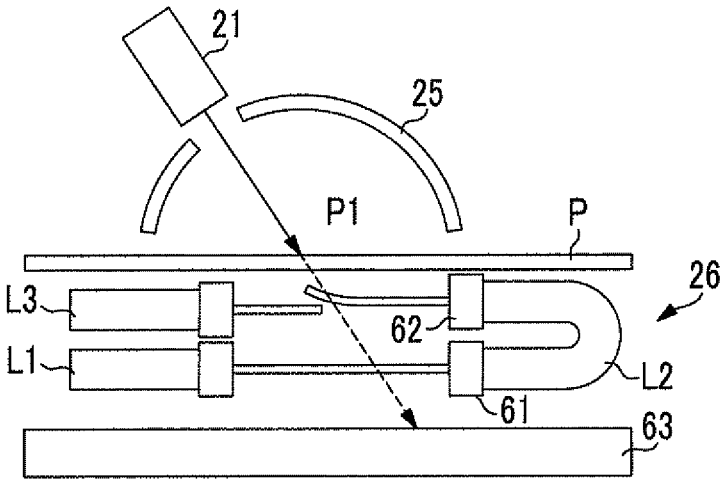

FIGS. 3A and 3B are diagrams illustrating the enlarged light generating portion 21 and power supply portion 26 shown in FIG. 1. The power supply portion 26 includes power supply lines L1, L2 and L3, a first power supply member 61, a second power supply member 62, and a protection member 63. The first power supply member 61, the second power supply member 62, and the protection member 63 are all provided opposite to the light generating portion 21 with the transport path S interposed therebetween in the direction in which laser light is emitted, and a distance from the light generating portion 21 is lengthened in order of the second power supply member 62, the first power supply member 61, and the protection member 63. In addition, all of the second power supply member 62, the first power supply member 61, and the protection member 63 are formed by separate members, and are attachable to and detachable from the fixing device 20 so as to be exchanged individually.

One end of the power supply line L1 of the power supply portion 26 is connected to a power source (not shown), and the other end thereof is connected to the first power supply member 61. In addition, the first power supply member 61 and the second power supply member 62 are connected to each other via the power supply line L2, and a terminal of the second power supply member 62 which is not connected to the power supply line L2 is connected to the power supply line L3. The second power supply member 62 and the light generating portion 21 are connected to each other via the power supply line L3. Power supplied from the power source is supplied to the light generating portion 21 via the power supply line L1, the first power supply member 61, the power supply line L2, the second power supply member 62, and the power supply line L3.

Figure 4:
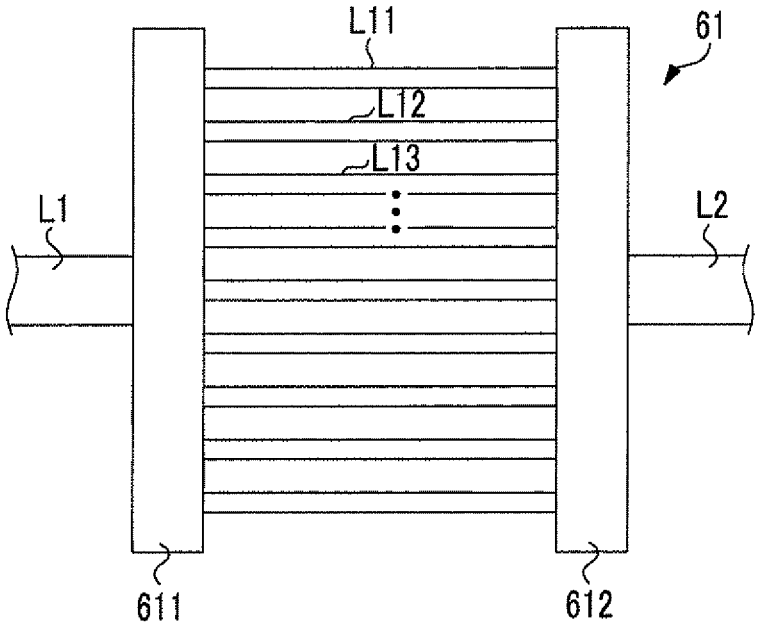
FIG. 4 is a diagram illustrating a configuration of a power supply member.

FIG. 4 is a diagram of the first power supply member 61 viewed from the arrow C1 direction of FIG. 3A. The first power supply member 61 includes terminal boards 611 and 612, and plural power supply lines L11, L12 . . . . As shown in FIG. 4, the power supply line L1 and the power supply line L2 are divided into plural lines via the terminal boards 611 and 612, and the terminal board 611 and the terminal board 612 are connected to each other via the plural power supply lines L11, L12 . . . , with a smaller diameter than the power supply lines L1 and L2. Each of the plural lines L11, L12 . . . is irradiated with laser light from the light generating portion 21, is increased in temperature, and is disconnected due to thermal melting when arriving at a specific temperature so as to interrupt the power supply between the terminal boards 611 and 612.

Figure 5:
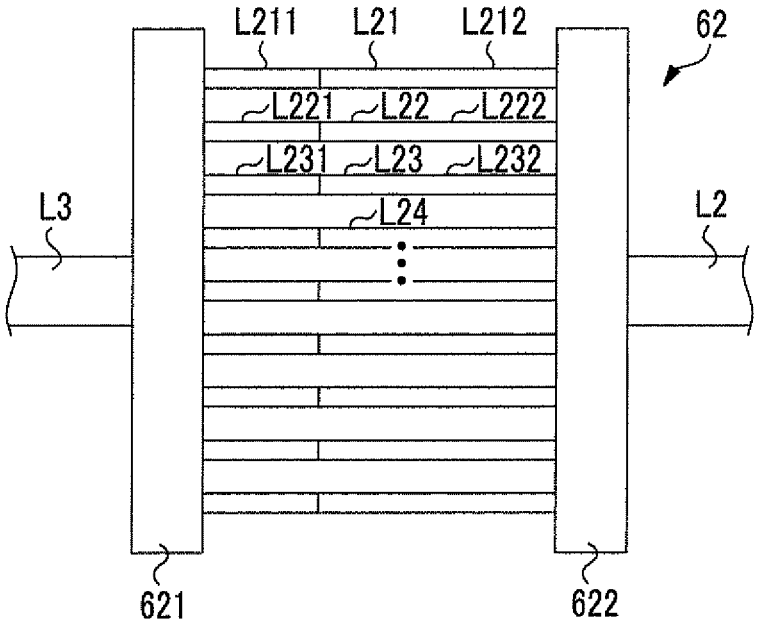
FIG. 5 is a diagram illustrating a configuration of a power supply interrupting mechanism.
Figure 6:
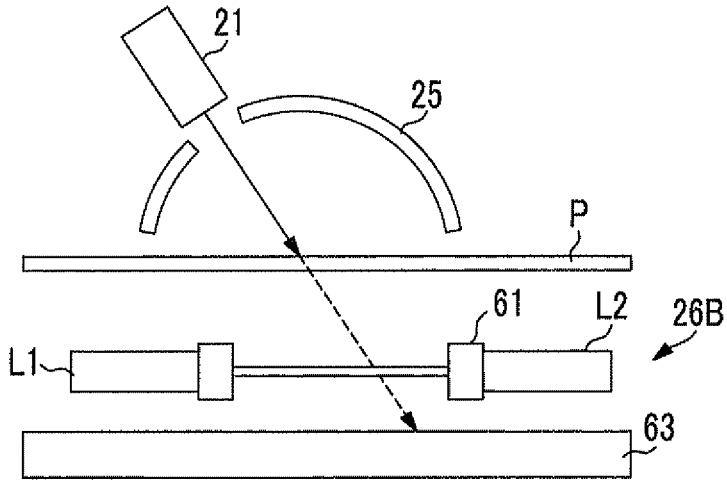
FIG. 6 is a diagram illustrating the light generating portion and the power supply portion.

FIG. 5 is a diagram of the second power supply member 62 viewed from the arrow C2 direction of FIG. 3A. As shown in FIG. 5, the second power supply member 62 includes terminal boards 621 and 622, and plural power supply lines L21, L22, . . . . As shown in FIG. 5, the power supply line L2 and the power supply line L3 are divided into plural lines via the terminal boards 621 and 622, and the terminal board 621 and the terminal board 622 are connected to each other via the plural power supply lines L21, L22 . . . , with a smaller diameter than the power supply lines L2 and L3. The power supply line L21 has a member L211 extending from the terminal board 621 side and a member L212 extending from the terminal board 622 side, and one end part of the member L211 and one end part of the member L212 are disposed so as to come into contact with each other. This is also the same for the power supply lines L22, L23, . . . .

The members L221, L222, . . . includes a shape memory alloy of which a shape is deformed according to temperature, and are deformed from the state shown in FIG. 3A into the state shown in FIG. 3B when temperature thereof increases due to irradiation with laser light from the light generating portion 21 and arrives at a specific temperature. As a result, the power supply paths between the terminal board 621 and the terminal board 622 are disconnected. In addition, after the members L221, L222, . . . are deformed into the state shown in FIG. 33, the members are deformed again into the state shown in FIG. 3A when temperature thereof decreases to a specific temperature. As a result, the power supply paths between the terminal board 621 and the terminal board 622 are connected.

The protection member 63 is a member which has a higher melting point than the power supply lines L11, L12, . . . and has a higher temperature causing thermal deformation than the power supply lines L11, L12, . . . , and protects members (not shown) disposed on the lower side of the protection member 63 in FIGS. 3A and 3B from damage due to laser light emitted from the light generating portion 21. The reflectance of the protection member 63 of the laser light may be low.

When laser light is emitted from the light generating portion 21 in a state in which the paper P is disposed at the irradiation position p1, some of the laser light passes through the paper P and arrives at each of the second power supply member 62, the first power supply member 61, and the protection member 63; however, a light intensity thereof is not an intensity which deforms or melts all of the second power supply member 62, the first power supply member 61, and the protection member 63.

On the other hand, for some reason, laser light is emitted from the light generating portion 21 in a state in which the paper P is not disposed at the irradiation position p1, some of the laser light passes through the paper P and arrives at each of the second power supply member 62, the first power supply member 61, and the protection member 63, and a light intensity thereof is larger than a case where the paper P is disposed at the irradiation position p1. Therefore, there is a probability where the second power supply member 62, the first power supply member 61, and the protection member 63 may be deformed or be melted due to the laser light.

When laser light is emitted from the light generating portion 21 in a state in which the paper P is not disposed at the irradiation position p1, time required for the power supply lines L11, L12, . . . to be melted is longer than time required for the members L221, L222, . . . of the power supply lines L22, L23, . . . to be deformed, and time required for the protection member 63 to be damaged is longer than time required for the power supply lines L11, L12, . . . to be melted.

Therefore, when laser light is irradiated from the light generating portion 21 in a state in which the paper P is not disposed at the irradiation position p1, first, the members L221, L222, . . . of the power supply lines L22, L23, . . . are deformed, and thereby the power supply paths between the terminal board 621 and the terminal board 622 are disconnected. For this reason, irradiation with the laser light from the light generating portion 21 stops. In a case where the members L221, L222, . . . of the power supply lines L22, L23, . . . are not deformed, or in a case where the members L221, L222, . . . are deformed but the power supply paths between the terminal board 621 and the terminal board 622 are not disconnected for some reason, successively, the power supply lines L11, L12, . . . are melted, and thus the power supply paths between the terminal boards 611 and 612 are disconnected.

Referring to FIG. 1 again, the description is continued. The controller 50 includes a processor such as a Central Processing Unit (CPU), a Read Only Memory (ROM), and a Random Access Memory (RAM). The ROM stores a program executed by the processor. When the program is executed by the processor, an image forming function of forming an image on the paper P based on image data received from an external apparatus is realized. In addition, the controller 50 monitors a state in which power is supplied to the light generating portion 21, and controls each constituent element so as to stop all processes regarding image formation including irradiation with laser light from the light generating portion 21 when the supply of power to the light generating portion 21 stops. The operation portion 52 is provided with various buttons for operating the image forming apparatus 1. The controller 50 controls the constituent element in response to an operation performed in the operation portion 52.

The display 54 includes a liquid crystal display device which is an example of the device displaying an image. The display 54 displays a menu screen for operating the image forming apparatus 1 under the control of the controller 50. The communication portion 53 includes a communication interface which is an example of the device communicating with an external computer apparatus. The communication portion 53 receives image data sent from other apparatuses such as the computer apparatus and supplies the received image data to the controller 50. The storage portion 51 includes a memory and stores the image data provided to the controller 50.

Operation

Next, an operation performed by the image forming apparatus 1 will be described. When receiving an instruction for an image process from other computer apparatuses, or receiving an instruction for an image process by a user operating the operation portion 52, the image forming apparatus 1 performs various image processes according to instructed content. When an image forming process is instructed, under the control of the controller 50, based on the supplied image data, the image forming portion 10 exposes the photoconductors 101Y, 101M, 101C and 101K using the exposure devices 103Y, 103M, 103C and 103K so as to form latent images, forms toner images using the developing devices 104Y, 104M, 104C and 104K according to the latent images, and transfers the toner images to the paper P. The fixing device 20 irradiates the toner images formed by the image forming portion 10 with laser light so as to fix the toner images to the paper P.

Here, it is assumed that some sort of abnormality occurs in the light generating portion 21, the controller 50, or the like, and laser light is emitted from the light generating portion 21 although the paper P is not transported to the irradiation position p1 of laser light on the transport path S. In this case, as described above, first, the members L221, L222, . . . of the power supply lines L22, L23, . . . of the second power supply member 62 are deformed, and thereby the power supply paths between the terminal board 621 and the terminal board 622 are disconnected. For this reason, irradiation with the laser light from the light generating portion 21 stops. When the supply of power to the light generating portion 21 stops, the controller 50 displays, for example, an error message on the display 54, and then controls the other constituent elements so as to stop all processes regarding the image formation including irradiation with laser light from the light generating portion 21. When the irradiation with laser light from the light generating portion 21 stops, temperature of the members L221, L222, . . . decreases, the members are deformed again, and the power supply paths between the terminal board 621 and the terminal board 622 are connected. Therefore, when the abnormality occurring in the image forming apparatus 1 disappears, the image forming apparatus 1 may resume the image forming process, for example, without exchanging the second power supply member 62.

In a case where the power supply paths using the above-described second power supply member 62 are not disconnected for some reason, as described above, successively, the power supply lines L11, L12, . . . of the first power supply member 61 are melted, and thus the power supply paths between the terminal boards 611 and 612 are disconnected. For this reason, irradiation with the laser light from the light generating portion 21 stops. Also in this case, the controller 50 displays, for example, an error message on the display 54, and then controls the other constituent elements so as to stop all processes regarding the image formation including irradiation with laser light from the light generating portion 21. In this case, when the abnormality occurring in the image forming apparatus 1 disappears, the image forming apparatus 1 may resume the image forming process by exchanging the first power supply member 61 damaged due to the melting.

As above, in a case where laser light is emitted from the light generating portion 21 although the paper P is not transported to the irradiation position p1 of laser light on the transport path S due to some sort of abnormality in the image forming apparatus 1, at least one of the second power supply member 62 and the first power supply member 61 change physical properties thereof according to an increase in temperature and automatically disconnect the power supply paths to the light generating portion 21. Therefore, inconvenience is removed in which laser light is emitted from the light generating portion 21 although the paper P is not disposed at the irradiation position p1, without performing software control.

Modified Examples

Although the exemplary embodiment of the invention is described, the invention is not limited to the exemplary embodiment and may be carried out in various other forms. Hereinafter, examples thereof will be described. In addition, the above-described exemplary embodiment and an aspect of each modified example may be combined.

Figure 7:
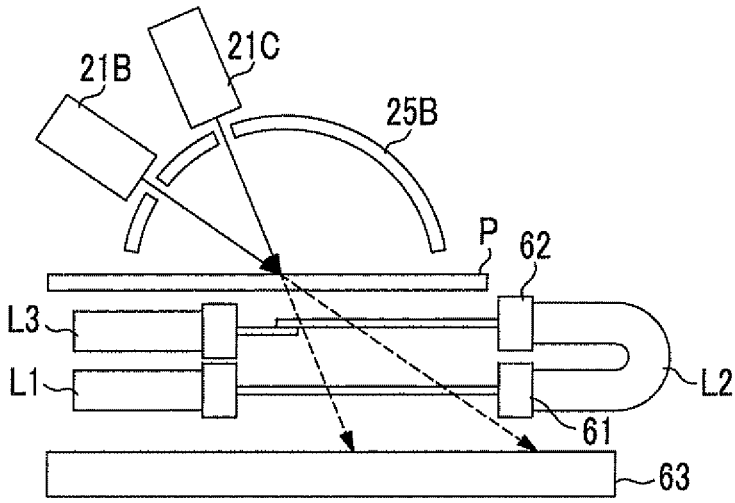
FIG. 7 is a diagram illustrating the light generating portion and the power supply portion.

(1) In the above-described exemplary embodiment, the number of the light generating portion 21 included in the fixing device 20 is one, but the number of light generating portions included in the fixing device may be two or more. For example, as shown in FIG. 7, two light generating portions 21B and 21C may be provided. Also in this case, the second power supply member 62, the first power supply member 61, and the protection member 63 may be located on light paths of the light generating portions 21B and 21C.

Figure 8:
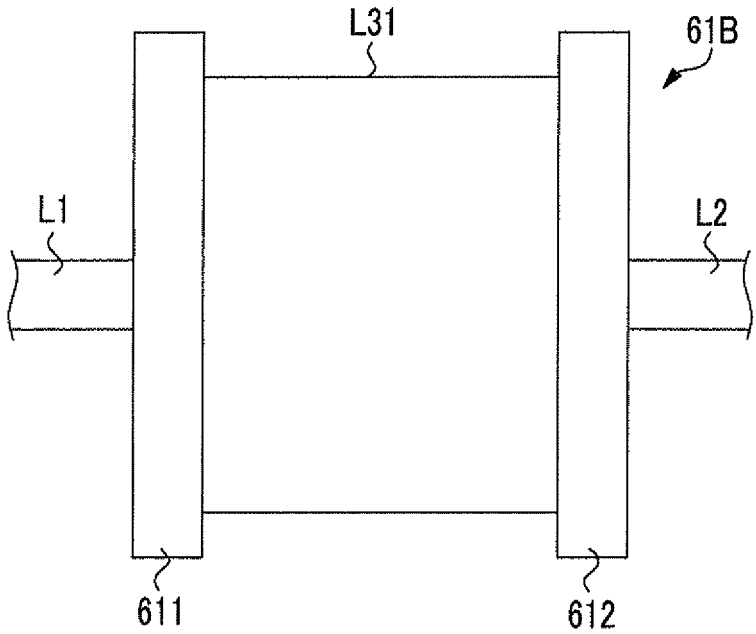
FIG. 8 is a diagram illustrating a configuration of the power supply member.

(2) In the above-described exemplary embodiment, the member in which two terminal boards 611 and 612 shown in FIG. 4 are connected to each other via the plural power supply lines L11, L12, . . . is used as the first power supply member 61, but a configuration of the first power supply member 61 is not limited thereto. For example, as shown in FIG. 8, two terminal boards 611 and 612 may be connected via a single belt-shaped power supply line L31.

(3) In the above-described exemplary embodiment, the fixing device 20 includes the first power supply member 61 and the second power supply member 62. Alternately, the fixing device 20 may include either one of the first power supply member 61 and the second power supply member 62.

(4) Although, in the above-described exemplary embodiment, the first power supply member 61, the second power supply member 62, and the protection member 63 are respectively attachable to and detachable from the fixing device 20, one or more members of the first power supply member 61, the second power supply member 62, and the protection member 63 may be fixed so as not to be attachable to and detachable from the fixing device 20. In addition, two or more members of the first power supply member 61, the second power supply member 62, and the protection member 63 may be integrally formed, and two more members integrally formed may be attachable to and detachable from the fixing device 20.

(5) In the above-described exemplary embodiment, the light generating portion 21 emits laser light. Alternatively, the light generating portion 21 may emit light other than laser light. In addition, although, in the above-described exemplary embodiment, the first power supply member 61 and the second power supply member 62 interrupt the supply of power to the light generating portion 21 by being irradiated with laser light, the supply of power may not be interrupted. For example, some of the power supply lines L11, L12, . . . of the first power supply member 61 may be disconnected, and thereby the supply of power to the light generating portion 21 may be reduced. In a case where the first power supply member 61 and the second power supply member 62 are continuously irradiated with laser light for a predefined time or more in a state in which the paper P is not disposed at the irradiation position, physical properties thereof may be changed due to irradiation with the laser light so as to reduce the supply of power to the light generating portion 21.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a light irradiation portion that irradiates a recording medium transported to a predefined position with light;

a power supply member that is disposed at a position which is irradiated with light with a first intensity of light emitted from the light irradiation portion in a state in which the recording medium is disposed at the predefined position and which is irradiated with light with a second intensity larger than the first intensity of light emitted from the light irradiation portion in a state in which the recording medium is not disposed at the predefined position, and that changes a physical property thereof so as to reduce the supply of power when the power supply member is continuously irradiated with the light with the second intensity for a predefined time or more; and a power supply portion that supplies power to the light irradiation portion via the power supply member.

2. The fixing device according to claim 1, wherein the power supply member is disconnected by being irradiated with the light with the second intensity.

3. The fixing device according to claim 1, wherein the power supply member is disconnected due to deformation according to an increase in temperature, and is connected again when temperature decreases.

4. An image forming apparatus comprising:

an image forming portion that forms a toner image on a recording medium; and the fixing device according to claim 1 that fixes the toner image formed by the image forming portion onto the recording medium.

5. An image forming apparatus comprising:

an image forming portion that forms a toner image on a recording medium; and the fixing device according to claim 2 that fixes the toner image formed by the image forming portion onto the recording medium.

* * * * *